United States Patent [19]

Fuyama et al.

[11] Patent Number: 4,877,994

[45] Date of Patent: Oct. 31, 1989

[54] ELECTROLUMINESCENT DEVICE AND PROCESS FOR PRODUCING THE SAME

[75] Inventors: Moriaki Fuyama; Katsumi Tamura; Kazuo Taguchi, Tokyo; Kenichi Onisawa, Hitachi; Akira Sato, Takahagi; Kenichi Hashimoto, Katsuta; Takahiro Nakayama, Hitachi; Yoshio Abe, both of Hitachi, all of Japan

[73] Assignee: Hitachi, Ltd., Tokyo, Japan

[21] Appl. No.: 172,415

[22] Filed: Mar. 23, 1988

[30] Foreign Application Priority Data

Mar. 25, 1987 [JP] Japan ..... 62-68880

[51] Int. Cl.[4] ..... H05B 33/22

[52] U.S. Cl. ..... 313/503; 313/505; 313/506; 313/509; 427/66; 427/69; 427/70; 428/690; 428/691; 428/917; 252/301.4 S; 252/306.4 H

[58] Field of Search ..... 313/503, 505, 506, 509; 427/66, 69, 70; 428/690, 691, 917; 252/301.4 S, 301.4 H

[56] References Cited

U.S. PATENT DOCUMENTS

| | | | |
|---|---|---|---|
| 4,416,933 | 11/1983 | Antson et al. | 313/503 |
| 4,442,377 | 4/1984 | Higton et al. | 313/503 |
| 4,720,436 | 1/1988 | Ohseto et al. | 313/503 |
| 4,725,344 | 2/1988 | Yocom et al. | 252/301.4 S |
| 4,727,004 | 2/1988 | Tanaka et al. | 313/503 |
| 4,734,618 | 3/1988 | Matsudaira et al. | 313/509 |
| 4,751,427 | 6/1988 | Barrow et al. | 313/503 |

FOREIGN PATENT DOCUMENTS 102983 6/1982 Japan .

*Primary Examiner*—Donald J. Yusko
*Assistant Examiner*—Michael Horabik
*Attorney, Agent, or Firm*—Antonelli, Terry & Wands

[57] ABSTRACT

An electroluminescent device comprising an electroluminescent layer capable of emitting light under application of AC voltage, the electroluminescent layer comprising strontium sulfide as a matrix and containing at least one of halides and sulfides of cerium, europium, thulium, terbium and samarium, and having a lattice constant of not more than 6.04 Å and a half-width value at the (111) face of not more than 0.21 degree has a higher brightness than an electroluminescent device having an electroluminescent layer comprising ZnS as a matrix.

19 Claims, 2 Drawing Sheets

ELECTROLUMINESCENT DEVICE AND PROCESS FOR PRODUCING THE SAME

BACKGROUND OF THE INVENTION

This invention relates to an electroluminescent (EL) device using strontium sulfide (SrS) as a matrix material for the electroluminescent layer and a process for producing the same, and particularly to an electroluminescent device suitable for flat display and a process for producing the same.

Japanese Patent Application Kokai (Laid-open) No. 60-172196 discloses an electroluminescent layer for a thin film electroluminescent device, which comprises zinc sulfide (ZnS) as a matrix material and contains at least one of manganese, copper, silver, magnesium, aluminum and their halides and further contains nitrogen, phosphorus, arsenic or antimony. It is further disclosed that the thin zinc sulfide film is formed by vacuum vapor deposition, or sputtering.

Television Gakai-shi, Vol. 40, No. 10, 991-997, (1986) disclosed vacuum vapor deposition of an electroluminescent layer comprising strontium sulfide (SrS) as a matrix material and containing cerium (Ce) for a thin film electroluminescent device.

The luminescence brightness of the thin film electroluminescent device having an electroluminescent layer comprising ZnS as a matrix material largely depends upon slight differences in the production conditions, as mentioned in said Japanese Patent Application Kokai (Laid-open) No. 60-172196, and it is hard to obtain electroluminescent devices of high luminescence brightness with a good reproducibility.

SUMMARY OF THE INVENTION

An object of the present invention is to provide an electroluminescent device having a higher brightness than that of electroluminescent devices using ZnS as an electroluminescent matrix material.

Another object of the present invention is to provide a process for producing an electroluminescent device of higher brightness with a good reproducibility.

According to the present invention, there is provided an electroluminescent device of high brightness, which comprises an electroluminescent layer capable of emitting light under application of AC voltage, the electroluminescent layer comprising strontium sulfide as a matrix and containing at least one of halides and sulfides of cerium, europium, thulium, terbium and samarium, and having a lattice constant of not more than 6.07 Å, preferably 6.02 to 6.07 Å, and a half-width value at the (111) face of not more than 0.21 degree. More particularly the present invention relates to an electroluinescent device which comprises a transparent substrate, stripe-shaped transparent electrodes, a first insulating layer, an electroluminescent layer capable of emitting light under application of AC voltage, a second insulating layer and stripe-shaped back side electrodes, laid one upon another, the electroluminescent layer comprising strontium sulfide as a matrix and containing at least one of halides and sulfides of cerium, europium, thulium, terbium and samarium, and having a lattice constant of not more than 6.07 Å and a half-width value at the (111) face of not more than 0.21 degree, where a ZnS layer can be provided on each side of the electroluminescent layer to improve the adhesion of the electroluminescent layer.

In the present invention, the content of S in SrS that constitutes the matrix of the electroluminescent layer is preferably at least 0.66 in terms of fluorescent X-ray diffraction intensity ratio, I(S)/I(Sr)+I(S). Furthermore, the electroluminescent layer of the present electroluminescent device is preferably formed by electron beam vapor deposition in vacuum of 9—$10^{-5}$ to $5\times10^{-4}$ Torr in the presence of sulfur vapors.

The present invention is based on findings that an electroluminescent layer comprising SrS as a matrix material and having a specific lattice constant and a specific half-width value can show a high electroluminescence brightness and that the high electroluminescence brightness can be obtained with a good reproducibility by forming the electroluminescent layer by electron beam vapor deposition in vacuum of $9\times10^{-5}$ to $5\times10^{-4}$ Torr in the presence of sulfur vapors.

The present inventors have studied improvement of brightness of CE-doped SrS, that is, SrS:Ce, as a material for the blue light-emitting layer. The present inventors at first investigated impurities in the raw materials for the electroluminescent layer, contamination of impurities from the vacuum chamber during the formation of the electroluminescent layer, contamination of impurities in the steps of mixing and molding the matrix material (SrS) with electroluminescent center material (Ce), etc. as causes for low brightness, but could not find satisfactory results. Furthermore, the present inventors investigated concentration of electroluminescent center material (Ce), vapor deposition rate, vacuum degree during the formation of the electroluminescent layer, etc., and found that the brightness could be increased not largely, but only slightly.

The present inventors assumed that no stoichiometric SrS was formed when a thin film SrS layer was made by electron beam vapor deposition, because the electroluminescent layer raw material LrS was very susceptible to thermal decomposition. That is, the present inventors assumed that SrS was thermally decomposed during the vapor deposition, resulting in a structure partially deficient in sulfur (S). On the basis of this assumption, the present inventors investigated the lattice constant, crystallinity, sulfur content, etc. of the formed SrS and found that the thin film SrS layer was deviated from the stoichiometric composition, as assumed.

During the vapor deposition of SrS, it was found that the following thermal decomposition reaction partially took place:

It was found that the resulting thin film SrS layer was in a structure partially deficient in sulfur, that is, in the form of $SrS_{1-x}$. By supplying sulfur vapors during the vapor deposition, the partially dissociated Sr could be made to react with sulfur vapors to form SrS again, and the resulting thin film SrS layer could take the stoichiometric composition and had a good crystallinity. As a result, the brightness could be greatly improved.

In the present invention, the deficiency in sulfur of the thin film SrS layer can be overcome by forming it in the presence of sulfur vapor or by simultaneous vapor deposition of sulfur, whereby a thin film SrS layer of high quality, that is, an electroluminescent device of high brightness, can be obtained.

The presence of sulfur vapor or simultaneous vapor deposition of sulfur during the vapor deposition is effective for the conversion of the partially dissociated Sr (SrS $\rightarrow$Sr +S) to SrS to overcome the deficiency in sulfur in the thin film SrS layer in the structure of $SrS_{1-x}$. That is, a thin film SrS layer of substantially stoichiometric composition can be formed thereby. The lattice constant and the half-width value of the this film SrS layer can be reduced and the stress and strains in the layer can be also reduced. That is, the crystallinity can be increased. The increase in the crystallinity of the thin film SrS layer plays an important role in improving the brightness, and in fact the brightness has been 100 to 1,000 times increased.

The present invention will be described in detail below, referring to Example and drawings.

PREFERRED EMBODIMENTS OF THE INVENTION

Figure 1:
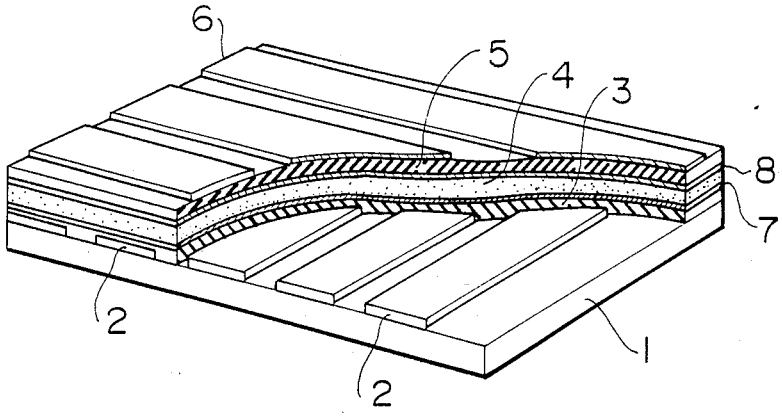
FIG. 1 is a partially cut-away perspective view of an electroluminescent device according to one embodiment of the present invention.

The structure of an electroluminescent device of the present invention is shown in FIG. 1.

A transparent electroconductive film was formed on a glass substrate 1 by high frequency sputtering (RF sputtering) to make the sheet resistance of 10 Ω/□. Then, the transparent electroconductive film was etched into a stripe-shaped pattern by photo-etching to form transparent electrodes 2. Furthermore, a first insulating layer 3 was formed thereon. The first insulating layer 3 was made from a 0.1 μm-thick $SiO_2$ film and a 0.4 μm-thick $Ta_2O_5$ film laid one upon another by RF sputtering.

Then, an electroluminescent layer 4 was formed thereon by electron beam vapor deposition from SrS containing 0.1% by mole of CeS as a raw material for the vapor deposition under those conditions as will be described in detail later.

To improve the adhesion between the first insulating layer 3 and the electroluminenscent layer 4, a ZnS layer 7 was formed to a thickness of 0.2 μm between the first insulating layer 3 and the electroluminescent layer 4 by electron beam vapor deposition at a substrate temperature of 200° C. Furthermore, another ZnS layer 8 was formed on another side of the electroluminescent layer 4 to a thickness of 0.2 μm in the same manner as above. That is, the SrS:Ce electroluminescent layer 4 was sandwiched with the ZnS layers 7 and 8 on both sides. Then, a second insulating layer 5 made from a 0.4 μm thick $Ta_2O_5$ film and a 0.1 μm-thick $SiO_2$ film, laid one upon another, was formed on the ZnS layer 8 on the electroluminescent layer 4. Then back side electrodes 6 were formed from metallic aluminum to a thickness of 0.2 μm in a stripe-shaped pattern on the second insulating layer 5 by mask vapor deposition so that the back side electrodes 6 can cross the transparent electrodes 2 at a right angle. A glass plate was placed on the back side of the thus prepared electroluminescent device and the entire border between the glass substrate 1 and the back side glass plate was tightly sealed with epoxy resin to prevent the electroluminescent device from moisture. The characteristics of the electroluminescent device was determined by measuring an electroluminescence brightness while applying a sine wave voltage of 5 kHz between the transparent electrodes 2 and the back side electrodes 6.

The SrS:Ce electroluminescent layer 4 was formed in the following manner in a vacuum two-source vapor deposition chamber having a electron beam evaporation source and a resistance heating evaporation source, where SrS:Ce was evaporated from the electron beam evaporation source and sulfur (S) from the resistance heating evaporation source at the same time.

That is, sulfur was evaported by placing a predetermined amount of sulfur powder in a tantalum (Ta) boat having an evaporation port, 1 mm in diameter, and heating the boat at predetermined temperatures by adjusting the electric current through the resistance heater, thereby controlling the rate of evaporated sulfur. That is, the vacuum degree for the SrS:C vapor deposition could be controlled by controlling the rate of evaporated sulfur. The SrS:Ce electroluminescent layer was formed to a thickness of about 0.3 μm at a constant substrate temperature of 500° C. at a vapor deposition rate of about 5Å/sec in the presence of sulfur vapor in the vacuum two-source vapor deposition chamber.

Figure 2:
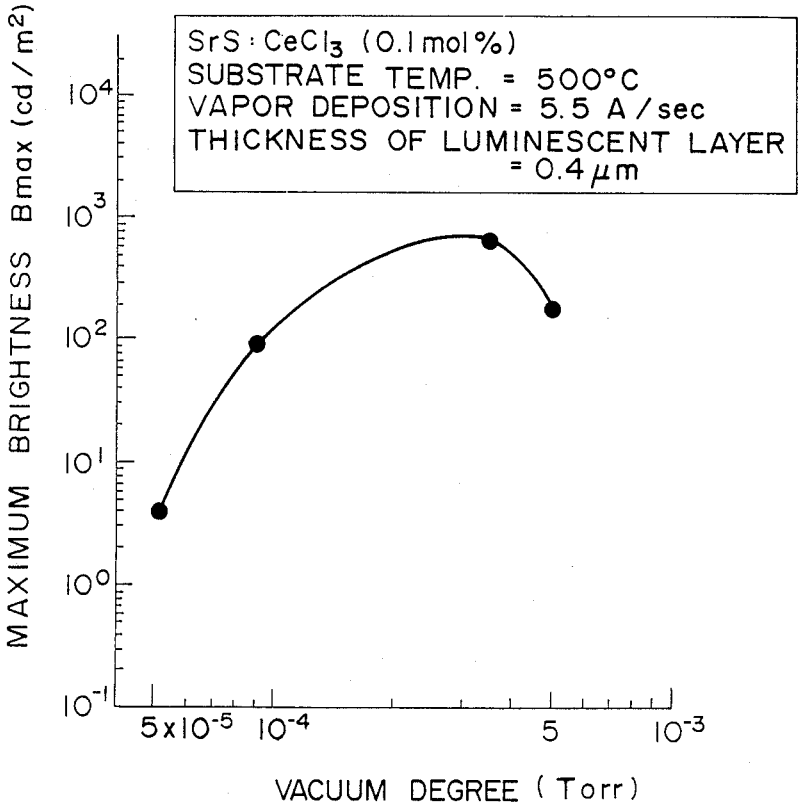
FIG. 2 is a diagram showing the relationship between the maximum brightness of the electroluminescent device according to the present invention and the vacuum degree at the vapor deposition.

The maximum brightness of electroluminescent devices prepared by changing the vacuum degree during the formation of electroluminescent layers is shown in FIG. 2 against vacuum degrees, where the vacuum degree on the abscissa is controlled with the rate of evaporated sulfur and the rate of evaporated sulfur increases with higher vacuum degree. That is, in FIG. 2, the vacuum degree of $5\times10^{-5}$ Torr corresponds to the condition where no sulfur evaporation takes place, i.e. there is no sulfur vapor. As is apparent from FIG. 2, the brightness largely increases with higher vacuum degree, that is, higher rate of evaporated sulfur, and when the vacuum degree exceeds $5\times10^{-4}$ Torr, the brightness tends to decrease on the contrary, but is still higher than that in the absence of sulfur vapors, that is, at the vacuum degree of $5\times10^{-5}$ Torr. It can be seen from FIG. 2 that the presence of sulfur vapors during the vapor deposition of the electroluminescent layer is very effective for the higher brightness.

Figure 3:
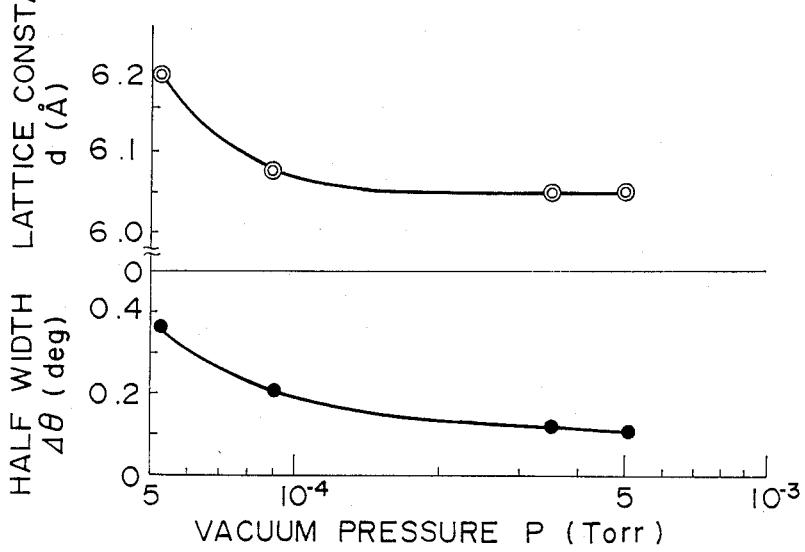
FIG. 3 is a diagram showing the relationship between the lattice constant or the half-width value of the luminescent layer according to the present invention and the vacuum degree at the vapor deposition.
Figure 4:
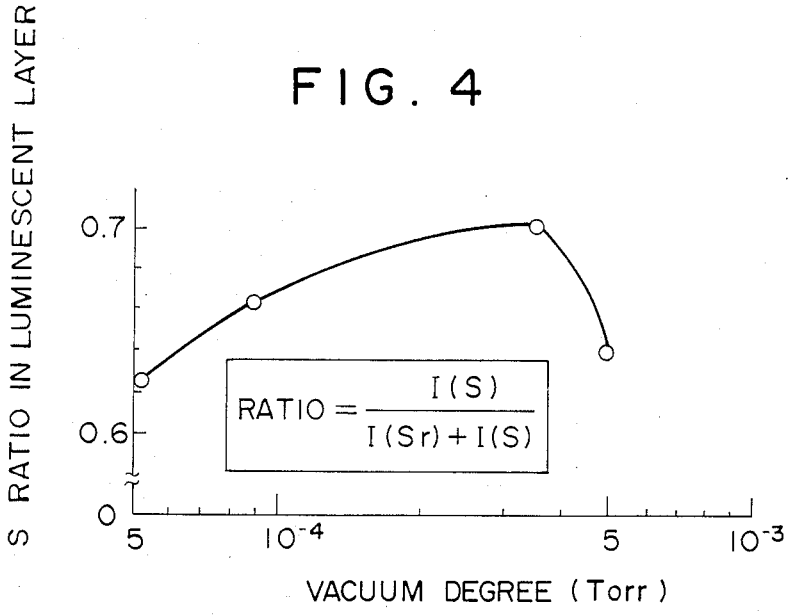
FIG. 4 is a diagram showing the relationship between the content of sulfur in the luminescent layer according to the present invention and the vacuum degree at the vapor deposition.

The higher brightness seems due to the improved quality of the thin film SrS:Ce layer as the electroluminescent layer. Results of X-ray analysis and fluorescent X-ray analysis of the electroluminescent layers prepared by changing the vacuum degree during the vapor deposition of the electroluminescent layers are shown in FIGS. 3 and 4. FIG. 3 shows the lattice constant and half-width value obtained from the (111) face of X-ray diffraction pattern. As is apparent from FIG. 3, the lattice constant decreases with higher vacuum degree and approaches the lattice constant of SrS powder (6.02Å) and the lattice constant of the electroluminescent layer obtained at the vacuum degree of $9\times10^{-5}$ Torr is 6.07Å. The brightness is improved at a higher vacuum degree than $9\times10^{-5}$ Torr (FIG. 2). The same tendency as that of the lattice constant is observable in the half-width value, and the half-width value decreases with higher vacuum degree. That is, it can be seen therefrom that the crystal grains in the thin film SrS:Ce electroluminescent layer becomes larger. The half-width $\Delta\theta$ at the vacuum degree of $9\times10^{-5}$ Torr is 0.21 degree and is much smaller than that in the absence of sulfur vapors (vacuum degree: $5 \times 10^{-5}$ Torr), that is, 0.37 degrees.

It can be seen therefrom that the brightness of the thin film SrS:Ce electroluminescent layer can be greatly improved by the presence of sulfur vapors during the vapor deposition of SrS:Ce and in order to improve the brightness the thin film SrS:Ce layer must have a lattice constant of not more than 6.07Å, preferably 6.02 to 6.07Å and a half-width value at the (111) face of X-ray diffraction pattern of not more than 0.21 degree.

FIG. 4 shows results of fluorescent X-ray analysis of sulfur content in the thin film SrS:Ce layers obtained by changing the vacuum degree during the vapor deposition, where the sulfur content in the electroluminescent layer is a S ratio obtained from the fluorescent X-ray intensities of Sr and S by way of I (S)/I(Sr)+I(S) and plotted on the ordinate. As is apparent from FIG. 4, the sulfur content in the thin film SrS:Ce layer is increased with the presence of sulfur vapors during the vapor deposition, and is larger than in the absence of sulfur vapor (vacuum degree: $5 \times 10^{-5}$ Torr). It is apparent from FIG. 2 that the brightness is increased with the increasing sulfur content in the thin film SrS:Ce layer.

By overcoming the deficiency in sulfur in the thin SrS:Ce layer, the lattice constant approaches 6.02 Å and the SrS:Ce layer approaches the stoichiometric composition. With decreased half-width value, the crystal grains become larger.

It can be seen from the foregoing results that the sulfur content in the thin film SrS:Ce layer must be at least 0.66 in terms of I(S)/I(Sr)+I(S) according to fluorescent X-ray analysis.

As described above, the deficiency in sulfur in the thin film SrS:Ce layer can be overcome by the presence of sulfur vapors during the vapor deposition of the electroluminescent layer of an electroluminescent device, whereby the quality of the device can be improved. The electroluminescence brightness of the device can be largely increased by the improved quality of the thin film SrS:Ce layer.

What is claimed is:

1. An electroluminescent device which comprises:
transparent electrodes formed on a transparent substrate;
a first insulating layer formed on the transparent electrodes;
an electroluminescent layer containing strontium sulfide as a matrix and having a lattice constant of not more than 6.07Å and a half-width at the (111) face of not more than 0.21 degree, formed on the first insulating layer;
a second insulating layer formed on the electroluminescent layer; and
back side electrodes formed on the second insulating layer.

2. An electroluminescent device according to claim 1 wherein the electroluminescent layer comprises strontium sulfide as a matrix and contains at least one of halides and sulfides of cerium, europium, thulium, terbium and samarium, and has good crystallinity so as to increase the brightness of the electroluminescent device.

3. An electroluminescent device of high brightness, which comprises an electroluminescent layer capable of emitting light under application of AC voltage, the electroluminescent layer comprising strontium sulfide as a matrix and containing at least one of halides and sulfides of cerium, europium, thulium, terbium and samarium, and having a lattice constant of not more than 6.07Å and a halfwidth value at the (111) face of not more than 0.21 degree.

4. An electroluminescent device according to claim 3, wherein the lattice constant is from 6.02 to 6.07Å.

5. An electroluminescent device according to claim 3, wherein the content of sulfur in the strontium sulfide in the electroluminescent layer is at least 0.66 in terms of a fluorescent X-ray diffraction intensity ratio of I(S)/I(Sr)+I(S).

6. An electroluminescent device according to claim 3, wherein the electroluminescent layer is formed by electron beam vapor deposition in vacuum of $9 \times 10^{-5}$ to $5 \times 10^{-4}$ Torr in the presence of sulfur vapors.

7. An electroluminescent device which comprises a transparent substrate, stripe-shaped transparent electrodes, a first insulating layer, an electroluminescent layer capable of emitting light under application of AC voltage, a second insulating layer and stripe-shaped back side electrodes, laid one upon another, the electroluminescent layer comprising strontium sulfide as a matrix and containing at least one of halides and sulfides of cerium, europium, thulium, terbium and samarium, and having a lattice consant of not more than 6.07Å and a half-width value at the (111) face of not more than 0.21 degree.

8. An electroluminescent device according to claim 7, wherein the lattice constant is from 6.02 to 6.07Å.

9. An electroluminescent device according to claim 7, wherein the content of sulfur in the strontium sulfide in the electroluminescent layer is at least 0.66 in terms of a fluorescent X-ray diffraction intensity ratio of I(S)/I(Sr)+I(S).

10. An electroluminescent device according to claim 7, wherein the electroluminescent layer is formed by electron beam vapor deposition in vacuum of $9 \times 10^{-5}$ to $5 \times 10^{-4}$ Torr in the presence of sulfur vapors.

11. An electroluminescent device according to claim 7, wherein a ZnS layer is provided on each side of the electroluminescent layer.

12. An electroluminescent device according to claim 7 wherein the transparent electrodes are formed on the substrate, the first insulating layer is formed on the transparent electrodes, the electroluminescent layer is formed on the first insulating layer, the second insulating layer is formed on the electroluminescent layer and the back side electrodes are formed on the second insulating layer.

13. A process for producing an electroluminescent device comprising an electroluminescent layer containing strontium sulfide as a matrix, which comprises:
forming a transparent electrode film on a transparent substrate;
patterning the transparent electrode film to form transparent electrodes;
forming a first insulating layer on the transparent electrodes;
forming the electroluminescent layer on the first insulating layer by electron beam vapor deposition in vacuum of $9 \times 10^{-5}$ to $5 \times 10^{-4}$ Torr in the presence of sulfur vapors;
forming a second insulating layer on the electroluminescent layer; and
forming back side electrodes on the second insulating layer.

14. A process according to claim 13, wherein the electroluminescent layer is formed by simultaneous vapor deposition of a mixture containing the strontium sulfide as the matrix by electron beam evaporation and sulfur by resistance heating.

15. A process according to claim 13, further comprising:

forming a first ZnS layer between the first insulating layer and the electroluminescent layer; and forming a second ZnS layer between the electroluminescent layer and the second insulating layer.

16. A process according to claim 13, wherein the first insulating layer includes a first $SiO_2$ film and a first $Ta_2O_5$ film formed on the first $SiO_2$ film, and the second insulating layer includes a second $Ta_2O_5$ film and a second $SiO_2$ film formed on the second $Ta_2O_5$ film.

17. A process according to claim 13, wherein the substrate is a glass substrate, the transparent electrodes are formed in a stripe-shaped pattern, and the back side electrodes are metallic electrodes formed in a stripe-shaped pattern so as to cross the transparent electrodes at right angles.

18. A process according to claim 13, wherein the electroluminescent layer has a lattice constant of not more than 6.07Å, a half-width value at the (111) face of not more than 0.21 degree, and the content of sulfur in the strontium sulfide of the electroluminescent layer is at least 0.66 in terms of a fluorescent x-ray diffraction intensity ratio of I(S)/I(Sr)+I(S).

19. A process according to claim 13, wherein the electroluminescent layer comprises strontium sulfide as a matrix and contains at least one of halides and sulfides of cerium, europium, thulium, terbium and samarium.

* * * * *